US006758128B2

(12) United States Patent
Iga et al.

(10) Patent No.: US 6,758,128 B2
(45) Date of Patent: Jul. 6, 2004

(54) HYDRAULIC CIRCUIT FOR WORKING MACHINE

(75) Inventors: Makoto Iga, Tokyo (JP); Yoshiyuki Shimada, Tokyo (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 0 days.

(21) Appl. No.: 10/181,154

(22) PCT Filed: Sep. 4, 2001

(86) PCT No.: PCT/JP01/07667

§ 371 (c)(1),
(2), (4) Date: Jul. 16, 2002

(65) Prior Publication Data

US 2003/0000374 A1 Jan. 2, 2003

(30) Foreign Application Priority Data

Nov. 20, 2000 (JP) ..... 2000-353168

(51) Int. Cl.[7] ..... F15B 11/08
(52) U.S. Cl. ..... 91/461; 60/422
(58) Field of Search ..... 91/461; 60/422; 137/625.6, 631.6

(56) References Cited

U.S. PATENT DOCUMENTS 5,081,905 A * 1/1992 Yagyu et al. ..... 91/461
5,102,102 A * 4/1992 Hidaka et al. ..... 91/461
5,490,384 A * 2/1996 Lunzman ..... 91/461
5,784,944 A * 7/1998 Tozawa et al. ..... 91/461
6,006,521 A * 12/1999 Fuchita et al. ..... 60/422

FOREIGN PATENT DOCUMENTS

JP A 61-2908 1/1986
JP 61002908 A * 1/1986 ..... F15B/13/042
JP U 6-25601 4/1994
JP A 7-248004 9/1995
JP A 9-235756 9/1997

* cited by examiner

*Primary Examiner*—Edward K. Look
*Assistant Examiner*—Igor Kershteyn
(74) *Attorney, Agent, or Firm*—Oliff & Berridge, PLC

(57) ABSTRACT

An oil hydraulic circuit having a pilot operated control valve, for performing control of pressure oil supply to a hydraulic actuator and a pilot valve gear for outputting a pilot pressure to the control valve, that improves operationality when a fine operation is performed. The pilot valve gear has a first pressure controller that outputs a pilot pressure corresponding to the degree of operation of an operating lever and a second pressure controller that reduces the pilot pressure outputted from the first pressure controller based on a signal from an operating speed changeover switch and outputs the reduced pilot pressure to the control valve.

7 Claims, 7 Drawing Sheets

HYDRAULIC CIRCUIT FOR WORKING MACHINE

BACKGROUND OF THE INVENTION

1. Field of Invention

The invention relates to a technical field of an hydraulic circuit for a working machine, such as a hydraulic excavator, provided with various hydraulic actuators.

2. Description of Related Art

In general, various hydraulic actuators are provided in a working machine, such as a hydraulic excavator, and working machines exist, which have a structure such that, while control of pressure oil supply to these hydraulic actuators is performed by a pilot operated type control valve, supply of a pilot pressure to the control valve is performed by a pilot valve for outputting a pilot pressure based on an operation with an operating tool. As an example thereof, a hydraulic circuit of a hydraulic cylinder to be provided in a hydraulic excavator is shown in FIG. 6. In FIG. 6, 1 denotes a hydraulic cylinder, 2 denotes a main hydraulic power source, 3 denotes a pilot hydraulic power source, 4 denotes a reservoir, 5 denotes a control valve, and 17 denotes a pilot valve (herein, in FIG. 6, 6 denotes a control valve for another hydraulic actuator 7 which shares an hydraulic power source of supply with the hydraulic cylinder 1). In this hydraulic circuit, a pilot pressure to be outputted from the pilot valve 17 becomes higher as the degree of operation with a control lever 12 becomes greater and, in addition, as the pilot pressure to be supplied becomes higher, the degree of opening of the control valve 5 becomes greater, the amount of pressure oil to be supplied to the hydraulic cylinder 1 increases, and expanding/contracting speed of the cylinder 1 accelerates. That is, a structure is provided such that the cylinder expanding/contracting speed is controlled in a manner corresponding to the degree of operation with the control lever 12, and the relationship between the degree of operation with the control lever 12 and cylinder expanding/contracting speed is as shown in FIG. 7, for example.

Meanwhile, in some cases where a minute operation is performed by slowly expanding/contracting the above hydraulic cylinder, such a maximum speed of the hydraulic cylinder as shown in FIG. 7 is not required, but expanding/contracting actions of the cylinder within a low-speed range indicated as the fine operation area are desirable. However, the range of operation with the control lever is narrow within the above fine operation area, therefore, it is necessary to operate the control lever while suppressing the degree of operation to a small amount. This makes an operator nervous, requires a great deal of skill, and results in poor workability, in which problems to be solved by the invention exist.

SUMMARY OF THE INVENTION

In light of the circumstances described above, the invention is created with the aim of solving the problems and provides an oil hydraulic circuit comprising a pilot operated type control valve for performing control of pressure oil supply to a hydraulic actuator and a pilot valve gear for outputting a pilot pressure to the control valve, wherein the pilot valve gear comprises a first pressure control means for outputting a pilot pressure corresponding to the degree of operation with an operating tool and a second pressure control means for reducing the pilot pressure outputted from the first pressure control means based on an external signal and outputting the reduced pilot pressure to the control valve.

Then, by providing such a structure, the acting speed of the hydraulic actuator with respect to the degree of operation with the operating tool can be made slow. Thus, the operationality and workability are improved in, for example, a case where a fine operation is performed.

In the oil hydraulic circuit, the second pressure control means comprises pressure-reducing valves which can switch over the respective states to an inactive state for outputting the pilot pressure from the first pressure control means to the control valve without a reduction, and to an active state for outputting the pilot pressure after a reduction and selector valves which switch over to a first position and to a second position based on an external signal. Further, the selector valves act to bring, at the first position, the respective pressure-reducing valves into an inactive state and, at the second position, into an active state, whereby selection between the case where a pilot pressure to be outputted from the second pressure control means to the control valve is reduced and the case where the same is not reduced can be performed by a switchover of the selector valve based on an external signal.

BRIEF DESCRIPTION OF THE DRAWINGS

The invention will be described with reference to the drawings, in which.

DETAILED DESCRIPTION OF PREFERRED EMBODIMENTS

An embodiment of the invention will be described based on the drawings.

Figure 1:
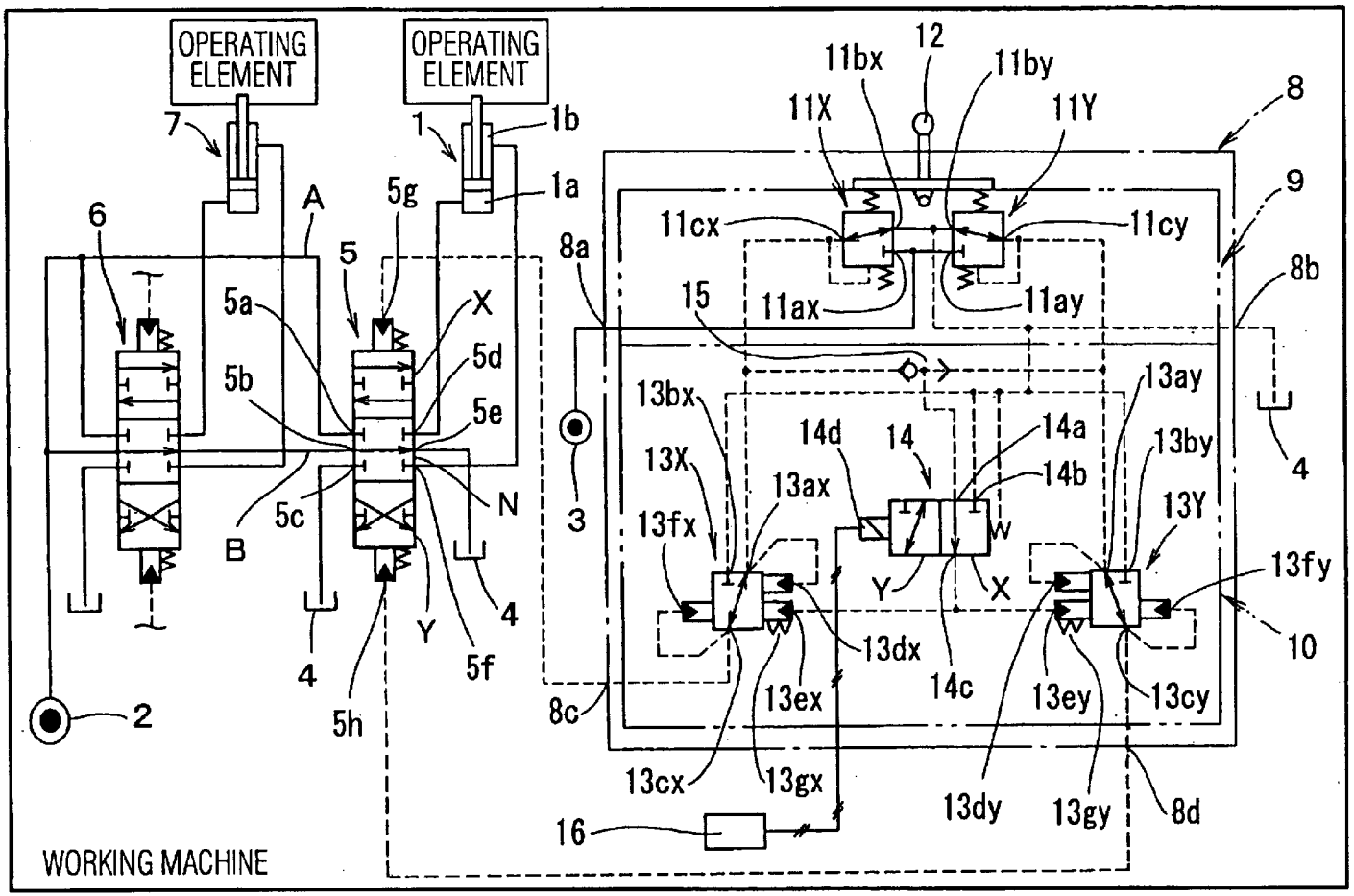
FIG. 1 is a hydraulic circuit diagram of a hydraulic cylinder.

First, in FIG. 1, a hydraulic circuit of a hydraulic cylinder 1 to be provided in a hydraulic excavator is shown. In the hydraulic circuit diagram, 2 denotes a main hydraulic power source, 3 denotes a pilot hydraulic power source, 4 denotes a reservoir, 5 denotes a control valve which performs pressure oil supplying/discharging control of the hydraulic cylinder 1. Further, 6 denotes a control valve for another hydraulic actuator 7 which uses the main hydraulic power source 2 as a hydraulic power source of supply.

The control valve 5 is a pilot operated type three-position selector valve and is provided with first through sixth ports 5*a*–5*f* and expanding-side and contracting-side pilot ports 5*g*, 5*h*, wherein the first port 5*a* is connected via a parallel oil path A to the main hydraulic power source 2, the second port 5*b* is connected via center bypass oil path B to the main hydraulic power source 2, the third port 5*c* is connected to the reservoir 4, the fourth port 5*d* is connected to an expanding-side oil chamber 1*a* of the hydraulic cylinder 1, the fifth port 5*e* is connected to the reservoir 4, and the sixth port 5*f* is connected to a contracting-side oil chamber 1*b* of the hydraulic cylinder 1.

Then, in a condition where no pilot pressure has been inputted to either pilot port 5*g* or 5*h*, the control valve 5 is located at a neutral position N where the first, third, fourth, and sixth ports 5*a*, 5*c*, 5*d*, 5*f* are respectively closed and also a bypassing valve path from the second port 5*b* to the fifth port 5*e* (a valve path for allowing pressure oil of the center bypass oil path B to flow directly to the reservoir 4) is opened.

On the other hand, when a pilot pressure is inputted into the expanding-side pilot port 5*g*, the control valve 5 switches over to an expanding-side position X where a supplying valve path from the first port 5*a* to the fourth port 5*d* (a valve path for supplying pressure oil of the parallel oil path A to the hydraulic cylinder expanding-side oil chamber 1*a*) and a discharging valve path from the sixth port 5*f* to the third port 5*c* (a valve path for discharging oil of the hydraulic cylinder contracting-side oil chamber 1*b* to the reservoir 4) are opened, whereby the hydraulic cylinder 1 is expanded.

Moreover, when a pilot pressure is inputted into the contracting-side pilot port 5*h*, the control valve 5 switches over to a contracting-side position Y where a supplying valve path from the first port 5*a* to the sixth port 5*f* (a valve path for supplying pressure oil of the parallel oil path A to the hydraulic cylinder contracting-side oil chamber 1*b*) and a discharging valve path from the fourth port 5*d* to the third port 5*c* (a valve path for discharging oil of the hydraulic cylinder expanding-side oil chamber 1*a* to the reservoir 4) are opened, whereby the hydraulic cylinder 1 is contracted.

Figure 2:
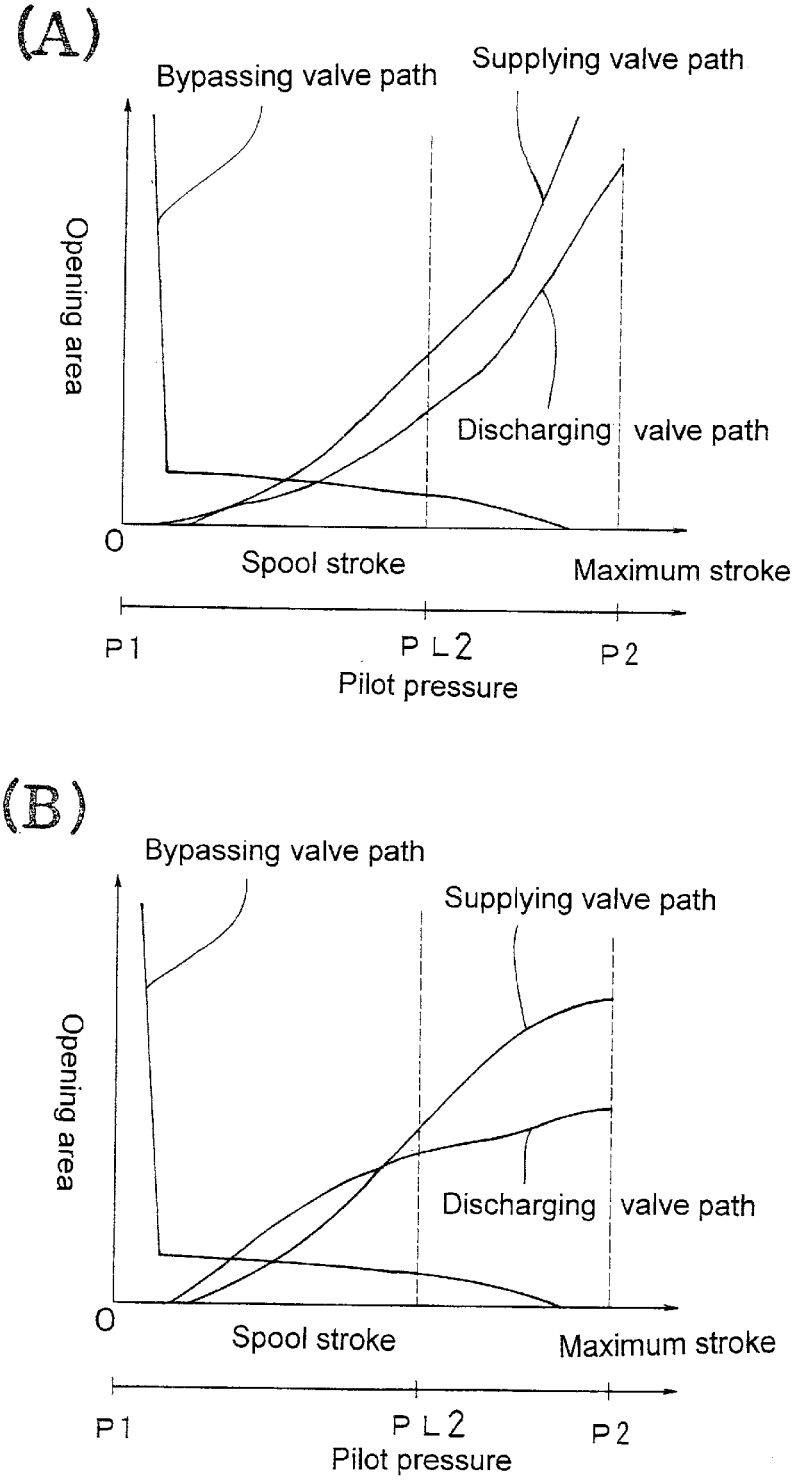
FIG. 2(A) is a diagram showing opening characteristics of a control valve when a hydraulic cylinder is expanded.
FIG. 2(B) is a diagram showing opening characteristics of a control valve when a hydraulic cylinder is contracted.

Herein, in terms of the times when the hydraulic cylinder 1 are expanded and contracted, characteristics diagrams showing the relationship between a pilot pressure to be inputted into the expanding-side and contracting-side pilot ports 5*g*, 5*h* and a spool stroke of the control valve 5 and an opening area of the bypassing valve path, supplying valve path, and discharging valve path of the control valve 5 are shown in FIGS. 2(A) and 2(B). As shown in the characteristics diagrams, in terms of the control valve 5, as the pilot pressure to be inputted becomes higher, the opening area of each of the supplying valve path and discharging valve path increases, whereby the amount of pressure oil to be supplied to the hydraulic cylinder 1 is increased, and the cylinder acting speed is increased. Herein, in FIGS. 2(A) and 2(B), P1 represents a minimum control pressure of the control valve 5 (the lowest pilot pressure necessary for the spool to switch over from the neutral position N to the expanding-side position X or the contracting-side position Y) and P2 represents a maximum control pressure of the control valve 5 (the lowest pilot pressure necessary for the spool to shift to a maximum stroke).

Furthermore, in the hydraulic circuit of FIG. 1, 8 denotes a pilot valve unit. The pilot valve unit 8 is provided with respective ports, that are, a pump port 8*a* to be connected to the pilot hydraulic power source 3, a tank port 8*b* to be connected to the reservoir 4, an expanding-side connection port 8*c* to be connected to the expanding-side pilot port 5*g* of the control valve 5, and a contracting-side connection port 8*d* to be connected to the contracting-side pilot port 5*h*, and also has a first pressure controller 9 and a second pressure controller 10 built-in, which will be described later.

The first pressure controller 9 comprises an expanding-side first pressure-reducing valve 11X and a contracting-side first pressure-reducing valve 11Y, and these first pressure-reducing valves 11X, 11Y are provided with, respectively, input ports 11*ax*, 11*ay* to be connected to the pump port 8*a*, drain ports 11*bx*, 11*by* to be connected to the tank port 8*b*, and output ports 11*cx*, 11*cy* to be connected to the second pressure controller 10, which will be described later. Then, in a condition where the control lever 12 for the hydraulic cylinder 1 has not been operated (at a neutral position of the control lever), the contracting-side first pressure-reducing valves 11X, 11Y do not output pilot pressure as the output ports 11*cx*, 11*cy* are connected to the tank port 8*b*.

Figure 3:
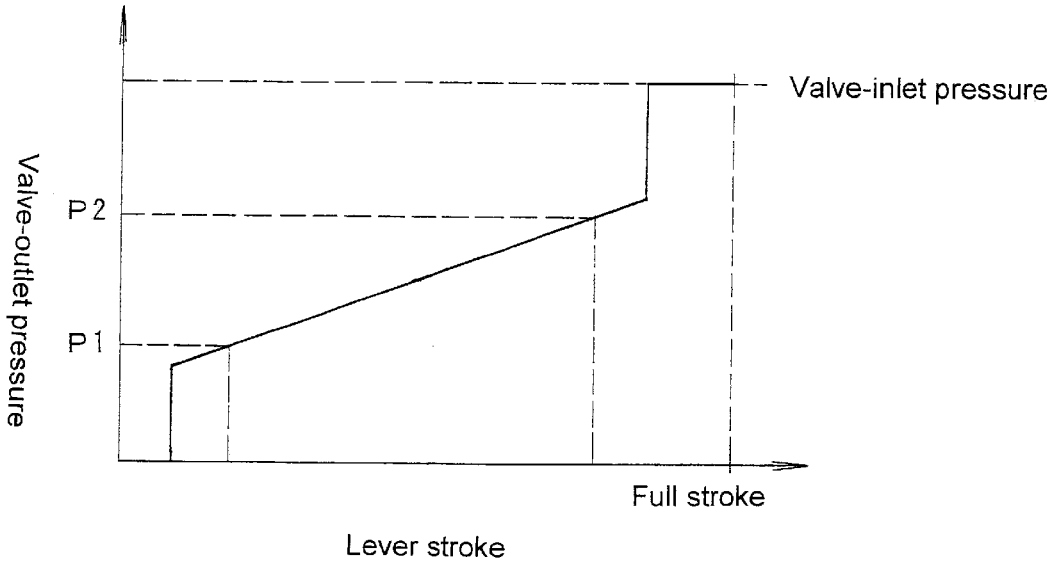
FIG. 3 is a diagram showing characteristics of a first pressure-reducing valve.

However, based on an operation of the control lever 12 to the expanding side and the contracting side, a pilot pressure corresponding to this degree of operation is to be outputted from the output ports 11*cx*, 11*cy*. In this case, the relationship between the degree of operation of the control lever 12 (lever stroke) and an output pressure from the output port 11*cx*, 11*cy* (valve-outlet pressure) has, in the embodiment, characteristics as shown in FIG. 3, which are set so that the output pressure (valve-outlet pressure) becomes equal to an inlet pressure (valve-inlet pressure) slightly before a full stroke. Also, in FIG. 3, P1 and P2 represent a minimum control pressure and a maximum control pressure of the control valve 5, which have been described above.

On the other hand, the second pressure controller 10 is composed of an expanding-side second pressure-reducing valve 13X, a contracting-side second pressure-reducing valve 13Y, an electromagnetic selector valve 14, and a shuttle valve 15. The inlet side of the shuttle valve 15 is connected to the output port 11*cx* of the expanding-side first pressure-reducing valve 11X and the output port 11*cy* of the contracting-side first pressure-reducing valve 11Y, and the outlet side thereof is connected to a first port 14*a* of the electromagnetic selector valve 14, which will be described later.

The shuttle valve 15 has a structure so that a higher pressure is selected out of pressures inputted from the inlet side and is outputted from the output side, thus in a case where a pilot pressure is outputted from the output port 11*cx* or 11*cy* of the expanding-side first pressure-reducing valve 11X or the contracting-side first pressure-reducing valve 11Y, the pilot pressure is to be inputted into the first port 14*a* through the shuttle valve 15.

In addition, the electromagnetic selector valve 14 is a two-position selector valve provided with first through third ports 14*a*–14*c*, wherein the first port 14*a* is connected to the outlet side of the shuttle valve 15, the second port 14*b* is connected to the tank port 8*b*, and the third port 14*c* is connected to second pistons 13*ex*, 13*ey* of the expanding-side second pressure-reducing valve 13X and the contracting-side second pressure-reducing valve 13Y, respectively, which will be described later.

Then, in a state where a solenoid 14*d* is unexcited, the electromagnetic selector valve 14 is located at a first position X where a valve path from the first port 14*a* to the third port 14*c* is opened and the second port 14*b* is closed. Then, in the condition where the electromagnetic selector valve 14 is located at the first position X, an outlet-side pressure of the shuttle valve 15, that is, a pilot pressure outputted from the output port 11*cx* or 11*cy* of the expanding-side first pressure-reducing valve 11X or the contracting-side first pressure-reducing valve 11Y is applied to the second pistons 13*ex* and 13*ey* of the expanding-side and contracting-side second pressure-reducing valves 13X and 13Y through the electromagnetic selector valve 14 located at the first position X.

On the other hand, in a state where the solenoid 14*d* is excited, the electromagnetic selector valve 14 closes the first port 14*a* and also switches over to a second position Y where the second port 14*b* and the third port 14*c* are communicated with each other. Then, in the condition where the electromagnetic selector valve 14 is located at the second position Y, an application line to the second pistons 13*ex*, 13*ey* of the expanding-side and contracting-side second pressure-reducing valves 13X, 13Y is connected with conductivity to the tank port 8*b* via the electromagnetic selector valve 14 located at the second position Y.

Herein, the solenoid 14*d* of the electromagnetic selector valve 14 has an electrical interconnection with an operating speed changeover switch 16 provided on an operator's seat portion or the like of the hydraulic excavator 1, and is in an unexcited state when the operating speed changeover switch 16 is OFF, but is excited based on turning ON of the operating speed changeover switch 16.

In addition, the expanding-side and contracting-side second pressure-reducing valves 13X, 13Y are provided with input ports 13*ax*, 13*ay*, drain ports 13*bx*, 13*by*, output ports 13*cx*, 13*cy*, first pistons 13*dx*, 13*dy*, second pistons 13*ex*, 13*ey*, third pistons 13*fx*, 13*fy*, and springs 13*gx*, 13*gy*, and terms of the expanding-side second pressure-reducing valve 13X, the input port 13*ax* is connected to the output port 11*cx* of the expanding-side first pressure reducing valve 11X, the drain port 13*bx* is connected to the tank port 8*b*, and the output port 13*cx* is connected to the expanding-side connection port 8*c*. In addition, in terms of the contracting-side second pressure-reducing valve 13Y, the input port 13*ay* is connected to the output port 11*cy* of the contracting-side first pressure-reducing valve 11Y, the drain port 13*by* is connected to the tank port 8*b*, and the output port 13*cy* is connected to the contracting-side connection port 8*d*. Furthermore, output pressures from the output ports 11*cx*, 11*cy* of the expanding-side and contracting-side first pressure-reducing valves 11X, 11Y are, respectively, applied to the first pistons 13*dx*, 13*dy* of the expanding-side and contracting-side second pressure-reducing valves 13X, 13Y, an output pressure from the output port 11*cx* or 11*cy* of the expanding-side first pressure-reducing valve 11X or the contracting-side first pressure-reducing valve 11Y is applied, as described above, to the second piston 13*ex* or 13*ey* via the electromagnetic selector valve 14 located at the first position X, and output pressures from the output ports 13*cx*, 13*cy* are applied to the third pistons 13*fx*, 13*fy*.

Then, the first and second pistons 13*dx*, 13*dy*, 13*ex*, 13*ey* and the springs 13*gx*, 13*gy* press the valve bodies of the second pressure-reducing valves 13X, 13Y to the side for an inactive state for outputting a pressure, which has been inputted into the input ports 13*ax*, 13*ay*, without reduction from the output ports 13*cx*, 13*cy*, and also the third pistons 13*fx*, 13*fy* press the valve bodies of the second pressure-reducing valves 13X, 13Y to the side for an active state for outputting a pressure, which has been inputted into the input ports 13*ax*, 13*ay*, from the output ports 13*cx*, 13*cy* by being reduced.

Herein, in a condition where the control lever 12 has been operated to the expanding side or the contracting side and a pilot pressure has been outputted from the output port 11*cx* or 11*cy* of the expanding-side or contracting-side first pressure-reducing valve 11X or 11Y, the relationship between force F1 for depressing the second pressure-reducing valves 13X and 13Y to the inactive state side and force F2 for pressing the second pressure-reducing valve 13X or 13Y to the active side is set as follows.

Namely, a relationship is set so that, in a condition where the electromagnetic selector valve 14 is located at the first position X and an output pressure from the output port 11*cx* or 11*cy* of the expanding side first pressure-reducing valve 11X or the contracting-side first pressure-reducing valve 11Y has been applied to the second piston 13*ex* or 13*ey*, the force F1 for pressing the second pressure-reducing valve 13X or 13Y to the inactive state side becomes greater than the force F2 for pressing the same to the active state side (F1>F2). Meanwhile in a condition where the electromagnetic selector valve 14 is located at the second position Y and the application line to the second piston 13*ex* or 13*ey* is connected with conductivity to the tank port 8*b*, the force F2 for pressing the second pressure-reducing valve 13X or 13Y to the active state side becomes greater than the force F1 for pressing the same to the inactive state side (F2>F1).

Then, in the case where the force F1, for pressing the second pressure-reducing valve 13X or 13Y to the inactive state side, is greater than the force F2, for pressing the same to the active state side, (F1>F2), the second pressure reducing valve 13X or 13Y is retained in an inactive state for outputting a pressure, which has been inputted into the input port 13*ax* or 13*ay*, from the output port 13*cx* or 13*cy* without a reduction. Thus, a pilot pressure outputted from the expanding-side or contracting-side first pressure-reducing valve 11X or 11Y in a manner corresponding to the degree of operation with the control lever 12 is, without a reduction, outputted from the expanding-side or contracting-side connection port 8*c* or 8*d* via the expanding-side or contracting-side second pressure-reducing valve 13X or 13Y in an inactive state, and is supplied to the expanding-side or contracting-side pilot port 5*g* or 5*h* of the control valve 5.

On the other hand, in the case where the force F2 for pressing the second pressure-reducing valve 13X or 13Y to the active state side is greater than the force F1 for pressing the same to the inactive state side (F2>F1), the second pressure-reducing valve 13X or 13Y is brought into an active state for outputting a pressure, which has been inputted into the input port 13*ax* or 13*ay*, from the output port 13*cx* or 13*cy* by being reduced. Thus, a pilot pressure outputted from the expanding-side or contracting-side first pressure-reducing valve 11X or 11Y in a manner corresponding to the degree of operation with the control lever 12 is, after a reduction by the second pressure-reducing valve 13X or 13Y in an active state, outputted from the expanding-side or contracting-side connection port 8*c* or 8*d*, and is supplied to the expanding-side or contracting-side pilot port 5*g* or 5*h* of the control valve 5.

Figure 4:
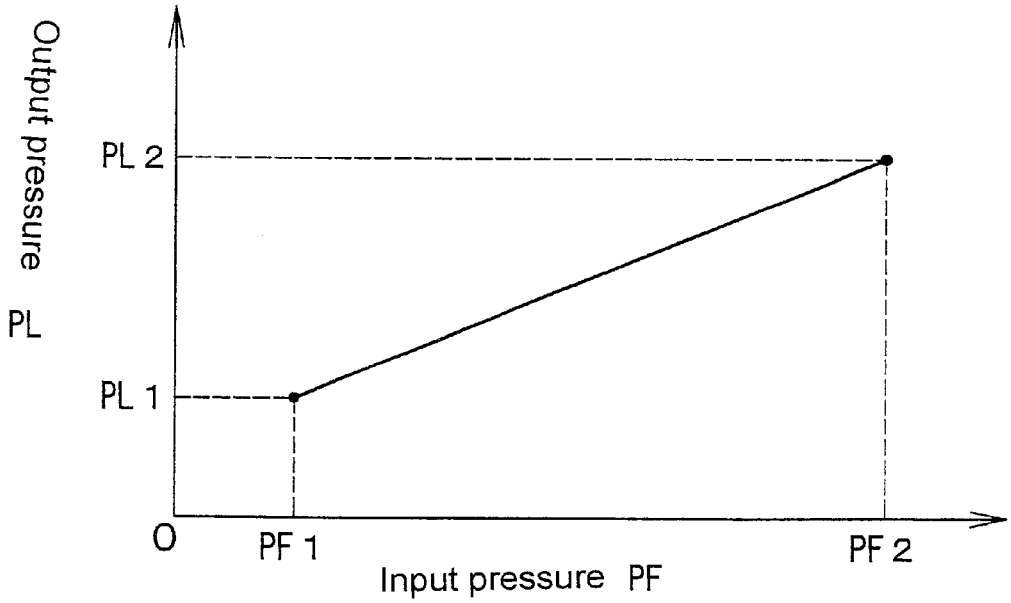
FIG. 4 is a diagram showing characteristics of a second pressure-reducing valve.

Herein, a pressure reducing action of the active second pressure-reducing valve 13X or 13Y in the above active state is shown in the characteristics diagram of FIG. 4. In FIG. 4, a minimum value PL1 of an output pressure PL from the output port 13*cx* or 13*cy* is equal to a minimum value PF1 of an input pressure PF inputted into the input port 13*ax* or 13*ay* (PL1=PF1) and, in addition, a maximum value PL2 of the output pressure PL becomes smaller than a maximum value PF2 of the input pressure PF (PL2<PF2). Furthermore, the maximum value PL2 of the output pressure PL is set so as to become smaller than the maximum control pressure P2 of the control valve 5 (PL2<P2) (refer to FIGS. 2(A) and 2(B)).

In addition, FIG. 4 shows such control that the output pressure PL with respect to the input pressure PF is reduced in a linear relationship (a proportionality relation). However, it is also possible to employ a non-linear relationship.

Figure 5:
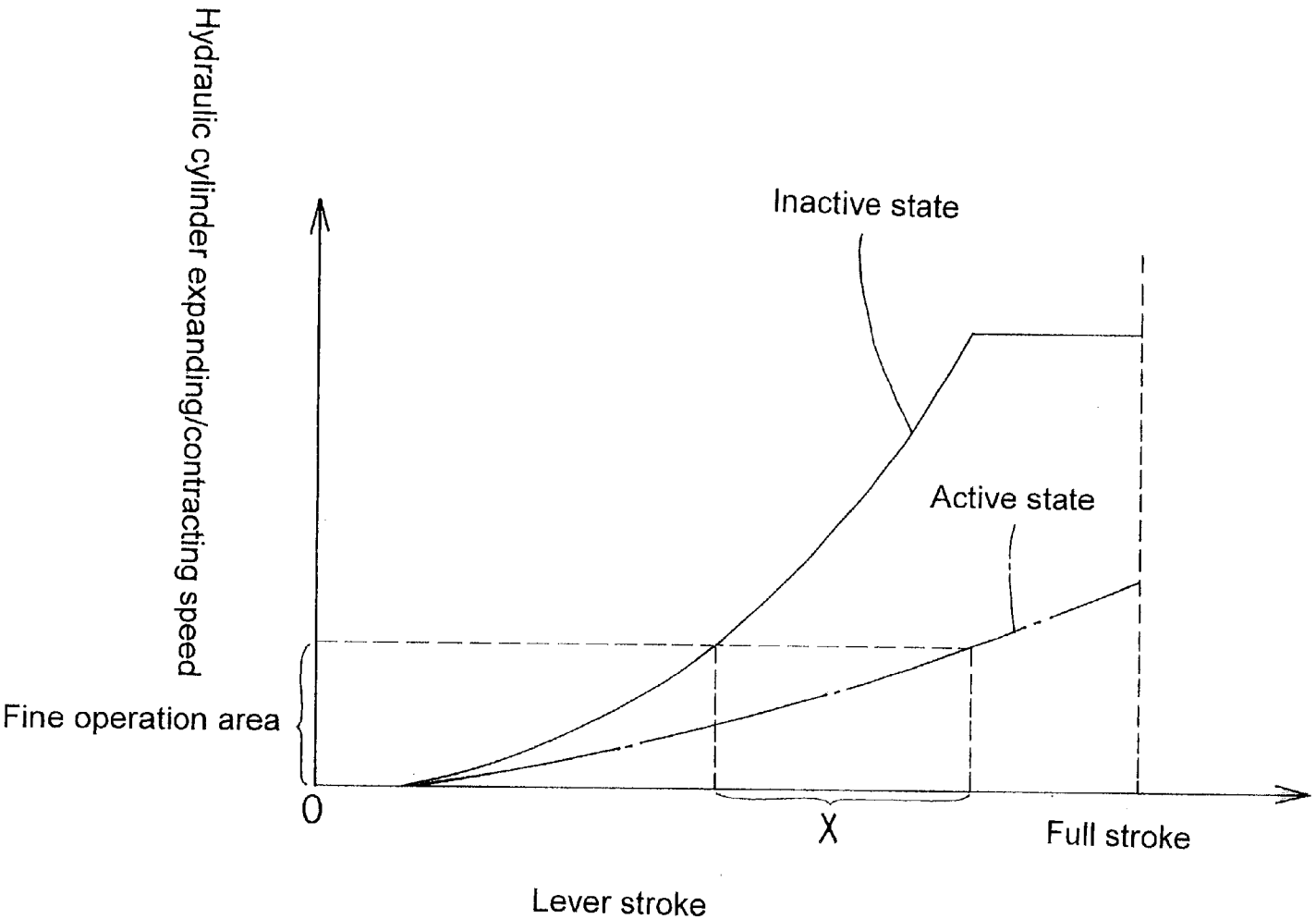
FIG. 5 is a diagram showing the relationships between the lever stroke and expanding/contracting speed of a hydraulic cylinder.
Figure 6:
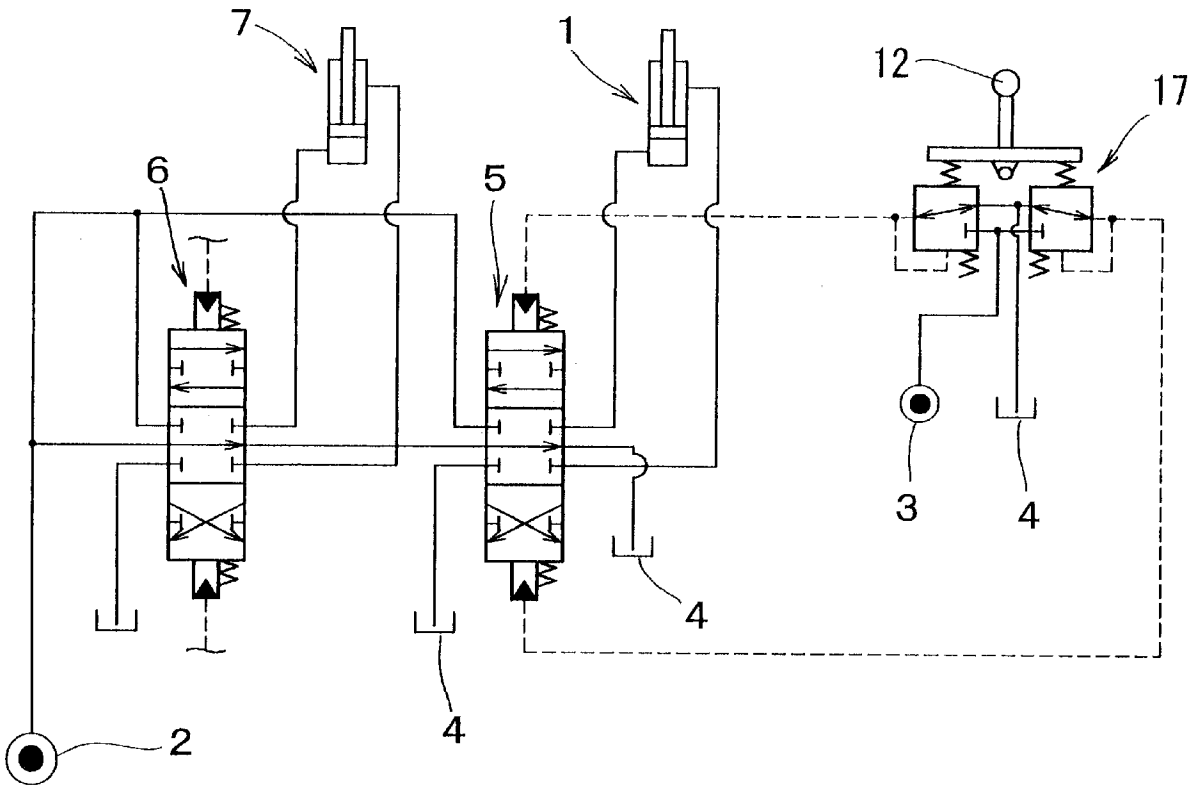
FIG. 6 shows a related art hydraulic circuit diagram.
Figure 7:
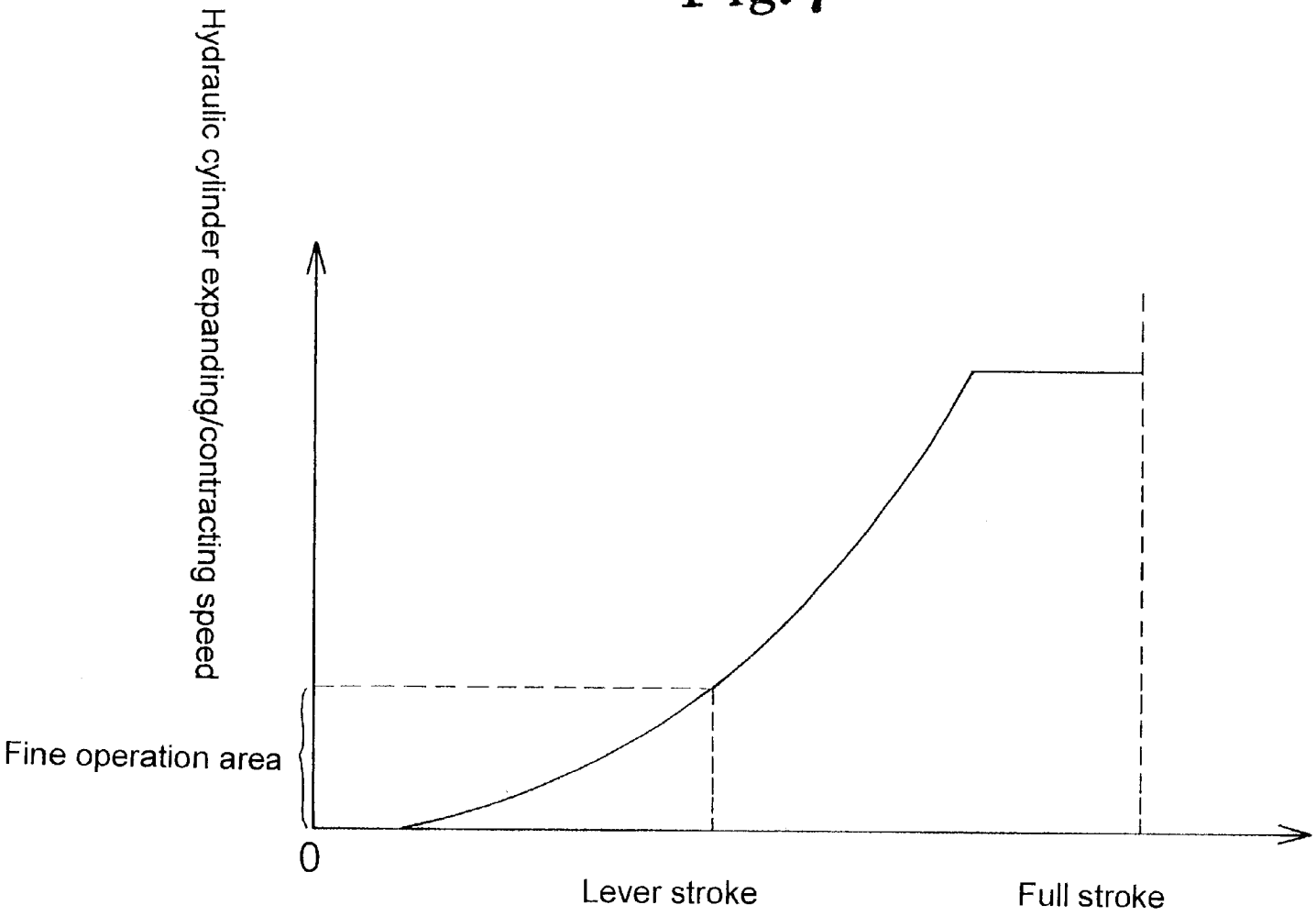
FIG. 7 is a diagram showing the relationship between the lever stroke and expanding/contracting speed of the circuit of FIG. 6.

Further, the relationships between the lever stroke of the control lever 12 and expanding/contracting speed of the hydraulic cylinder 1 when the second pressure-reducing valve 13X or 13Y is in an inactive state and in an active state are shown in FIG. 5. As shown in the FIG. 5, in the active state of the second pressure-reducing valve 13X or 13Y, the expanding/contracting speed of the hydraulic cylinder 1 declines throughout the whole lever stroke area. Moreover, in the active state of the second pressure-reducing valve 13X or 13Y, the lever stroke range in a low-speed area of the hydraulic cylinder 1, which is shown in FIG. 5 as a fine operation area, becomes broader by X than that of the inactive state.

In the embodiment structured as has been described above, the pilot valve unit 8 for outputting a pilot pressure to the control valve 5 which performs pressure oil supplying/discharging control of the hydraulic cylinder 1 comprises the first pressure controller 9 for outputting a pilot pressure corresponding to the degree of operation with the control lever 12 and the second pressure controller 10 for reducing the pilot pressure outputted from the first pressure controller 9 based on turning ON of the operating speed changeover switch 16 and outputting the reduced pilot pressure to the control valve 5.

As a result, in a case where a minute operation is performed by slowly expanding/contracting the hydraulic cylinder 1 without requiring its maximum speed, by turning ON the operating speed changeover switch 16, a pilot pressure to be outputted from the pilot valve unit 8 to the control valve 5 declines, and the expanding/contracting speed of the hydraulic cylinder 1 with respect to the degree of operation with the control lever 12 is slow throughout the whole lever stroke area. Thus, in the case where a fine operation of the hydraulic cylinder is performed, a lever control which conventionally requires a great deal of skill where operation is minutely performed for suppressing the degree of operation to a small amount becomes unnecessary. As a result, operationality and workability are improved.

Moreover, herein, the pilot valve unit 8 has a structure where the first pressure controller 9 for outputting a pilot pressure corresponding to the degree of operation of the control lever 12 and the second pressure control means 10 for reducing the pilot pressure outputted from the first pressure controller 9 are integrally built in, therefore, installation into a working machine, such as a hydraulic excavator, is easily carried out. Also, because the pilot valve unit 8 is attached in place of an existing pilot valve, replacement is easily carried out.

As a matter of course, the invention is not limited to the above embodiment, and means for outputting an external signal to cause the second pressure control means to perform a pressure reducing action is not limited to the operating speed changeover switch 16 and any means may be employed as long as it can output an external signal to the second pressure control means when the need arises.

In addition, as a structure of the second pressure control means, a structure may also be employed such that pressure-reducing valves for outputting a pilot pressure to be outputted from the first pressure control means to a control valve after a reduction and selector valves which switch over to a first position and a second position based on an external signal are provided. Further, the selector valves act to supply, at the first position, a pilot pressure from the first pressure control means to the control valve without passing through the pressure-reducing means, and to supply, at the second position, the same to the control valve through the pressure-reducing valve.

In the above embodiment, the pilot valve unit wherein the invention has been carried out is provided in the hydraulic circuit of the hydraulic cylinder of a hydraulic excavator. However, it may also be provided in an hydraulic circuit of a hydraulic motor, such as a travelling motor and a motor for rotation, and another hydraulic actuator, such as a hydraulic actuator for attachment. In addition, the invention may be carried out not only in a hydraulic excavator but also in various working machines provided with hydraulic actuators.

In summary, a pilot valve unit of the invention comprises a first pressure control means for outputting a pilot pressure corresponding to the degree of operation with an operating tool and a second pressure control means for reducing the pilot pressure outputted from this first pressure control means based on an external signal and outputting the reduced pilot pressure to the control valve. As a result, the acting speed of a hydraulic actuator with respect to the degree of operation with the operating tool can be slowed throughout the whole operating area of the operating tool when the need arises. As a result, for example, in the case where a fine operating is performed, operationality and workability are improved.

In addition, the first pressure control means and the second pressure control means are integrally built into the pilot valve gear. Therefore, installation into a working machine is easily carried out, and also an advantage exists such that in a case where the pilot valve gear is attached in place of an existing pilot valve, replacement is easily carried out.

What is claimed is:

1. A hydraulic circuit for a working machine, comprising:

a pilot operated control valve that performs control of pressure oil supply to a hydraulic actuator; and a pilot valve unit that outputs a pilot pressure to the control valve, wherein the pilot valve unit comprises:

a first pressure control device that outputs a pilot pressure corresponding to the degree of operation of an operating lever; and a second pressure control device that inputs the pilot pressure outputted from the first pressure control device as an input pressure and that reduces said input pressure in a proportional relationship until reaching the maximum value based on an external signal, outputs the reduced pressure as an output pressure as a second pilot pressure into the control valve.

2. The hydraulic circuit for a working machine as set forth in claim 1, wherein the second pressure control device comprises:

pressure-reducing valves which can switch between an inactive state for outputting the pilot pressure from the first pressure control device to the control valve without a reduction and an active state for outputting by reducing the pilot pressure in a proportional relationship until reaching the maximum value after a reduction; and selector valves which switch between a first position and a second position based on the external signal, wherein the selector valves act to bring, at the first position, the respective pressure-reducing valves into an inactive state and, at the second position, into an active state.

3. A working machine having a hydraulic circuit, comprising:

a control lever;

a working tool hydraulically connected to the control lever;

a pilot valve unit, comprising:

a pair of first pressure reducing valves linked to the control lever, a first pressure reducing valve associated with each direction of movement of the control lever;

a selector valve that switches the hydraulic circuit between fine control and normal control; and a pair of second pressure reducing valves, a second pressure reducing valve hydraulically connected to both a corresponding first pressure reducing valve of the pair of first pressure reducing valves and the selection valve; and a control valve hydraulically connected through a pilot port at each end to a respective one second pressure reducing valve of the pair of second pressure reducing valves wherein pressure of hydraulic fluid fed into the pilot port of the control valve is determined by a position of the selector valve.

4. The working machine according to claim 3, further comprising a changeover switch that controls the position of the selector valve.

5. The working machine according to claim 3, further comprising a pilot hydraulic power source.

6. The working machine according to claim 5, further comprising:

a main hydraulic power source; and a hydraulic actuator, wherein the control valve controls feed of hydraulic fluid from the main hydraulic power source to the hydraulic actuator based on the pressure of hydraulic fluid fed into the pilot port of the control valve from the pilot valve unit.

7. The working machine according to claim 3, further comprising:

a main hydraulic power source; and a hydraulic actuator, wherein the control valve controls feed of hydraulic fluid from the main hydraulic power source to the hydraulic actuator based on the pressure of hydraulic fluid fed into the pilot port of the control valve from the pilot valve unit.

* * * * *